United States Patent [19]

Stacik et al.

[11] Patent Number: 4,709,951

[45] Date of Patent: Dec. 1, 1987

[54] OPEN LID LATCHING MECHANISM FOR AUTOMATIC WASHER

[75] Inventors: Harold S. Stacik, St. Joseph Township, Berrien County; Warren R. Hafstrom, Lincoln Township, Berrien County, both of Mich.

[73] Assignee: Whirlpool Corporation, Benton Harbor, Mich.

[21] Appl. No.: 843,918

[22] Filed: Mar. 21, 1986

Related U.S. Application Data

[63] Continuation of Ser. No. 551,970, Nov. 15, 1983.

[51] Int. Cl.[4] ..... E05C 1/10

[52] U.S. Cl. ..... 292/189; 220/335; 292/DIG. 69

[58] Field of Search ..... 292/183, 184, 145, 189, 292/DIG. 15, 175, 163, 302, DIG. 69, 171, 176, 32, 42, 254, 343, 74; 248/240.4; 16/82, 83; 220/335

[56] References Cited

U.S. PATENT DOCUMENTS

| | | | |
|---|---|---|---|
| 315,979 | 4/1885 | Von Hollen | 292/189 |
| 815,553 | 3/1906 | Pettijohn | 292/189 |
| 925,184 | 6/1909 | Hess | 292/74 X |
| 1,341,569 | 5/1920 | Magee | 292/189 |
| 1,635,566 | 7/1927 | Victorsohn | 292/74 |
| 1,834,792 | 12/1931 | Mastrangelo et al. | 248/240.4 X |
| 1,854,657 | 4/1932 | Krueger | 292/189 |
| 1,859,003 | 5/1932 | Ragan | 292/175 X |
| 2,516,630 | 7/1950 | Hufnagel | 292/163 |
| 2,759,746 | 8/1956 | Sitterly | 292/145 |
| 3,233,932 | 2/1966 | Utterback | 292/175 |
| 3,330,585 | 7/1967 | Pollin | 292/175 X |
| 3,480,315 | 11/1969 | Wolverton | 292/175 |
| 3,709,539 | 1/1973 | Sodenkamp | 292/145 |
| 3,736,779 | 6/1973 | Pratt | 292/184 X |
| 4,550,945 | 11/1985 | Englehardt | 292/183 X |

FOREIGN PATENT DOCUMENTS

| | | | |
|---|---|---|---|
| 103785 | 7/1926 | Austria | 292/177 |
| 917008 | 1/1963 | United Kingdom | 292/179 |
| 1092306 | 11/1967 | United Kingdom | 292/163 |

*Primary Examiner*—Richard E. Moore

*Attorney, Agent, or Firm*—Hill, Van Santen, Steadman & Simpson

[57] ABSTRACT

A latch mechanism is provided for an automatic washer/dryer combination unit which positively latches the lid of the washer unit upon rotation of the washer lid to an open position. The latch mechanism operates automatically by gravitational action after rotation of the lid past the latch pin. No mechanical or magnetic forces are required for the latching action. Further, the latch mechanism is adaptable to latch differently sized lids in different mounting arrangements.

9 Claims, 6 Drawing Figures

FIG. 3
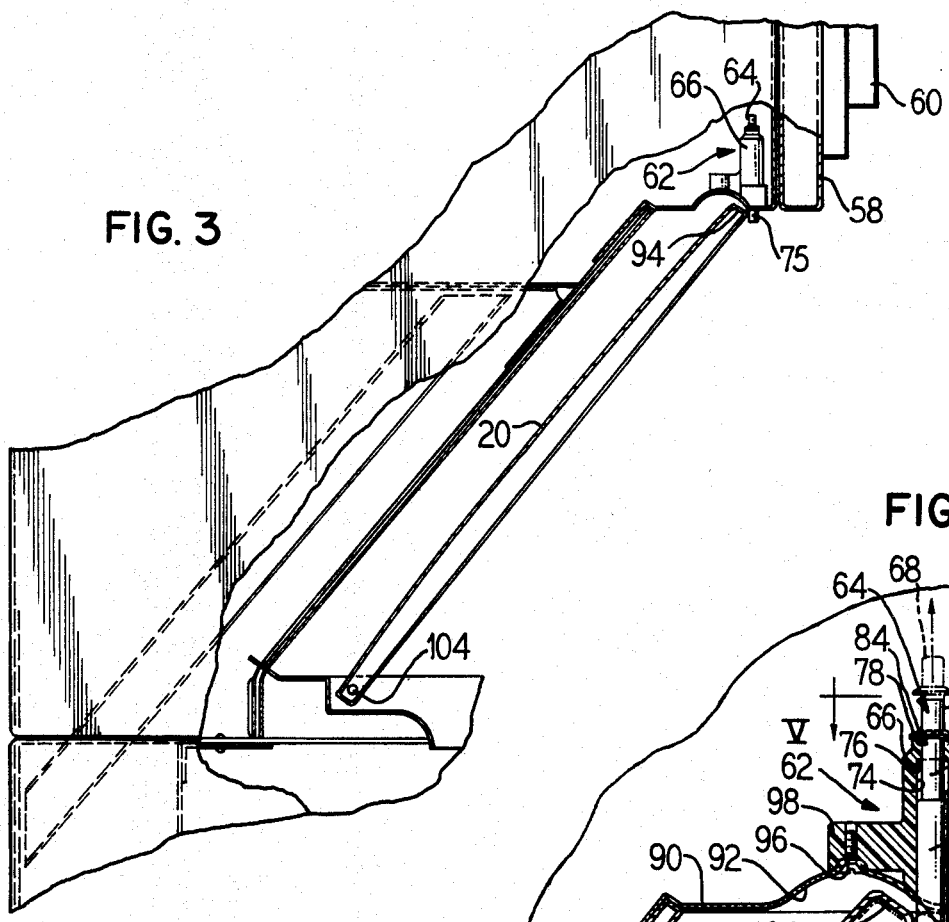
FIG. 4
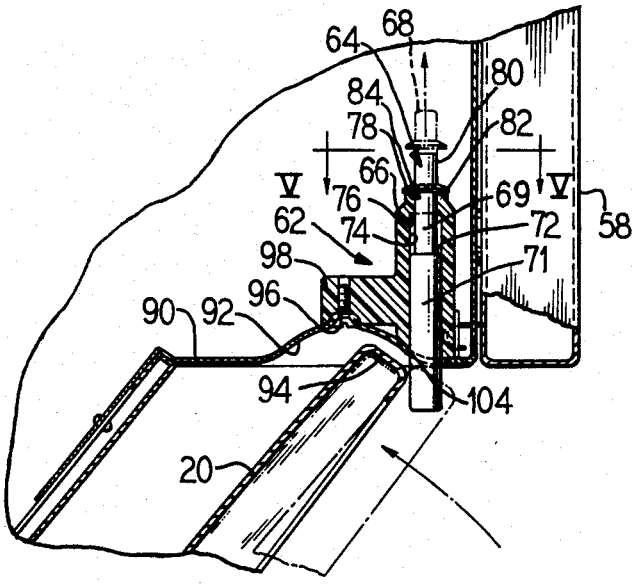
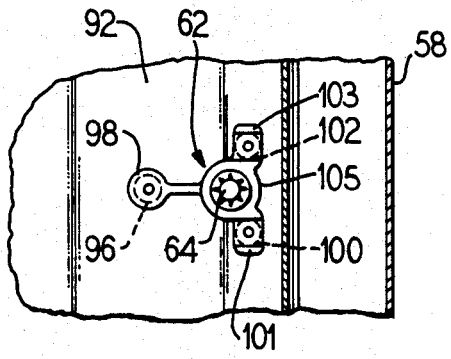
FIG 5
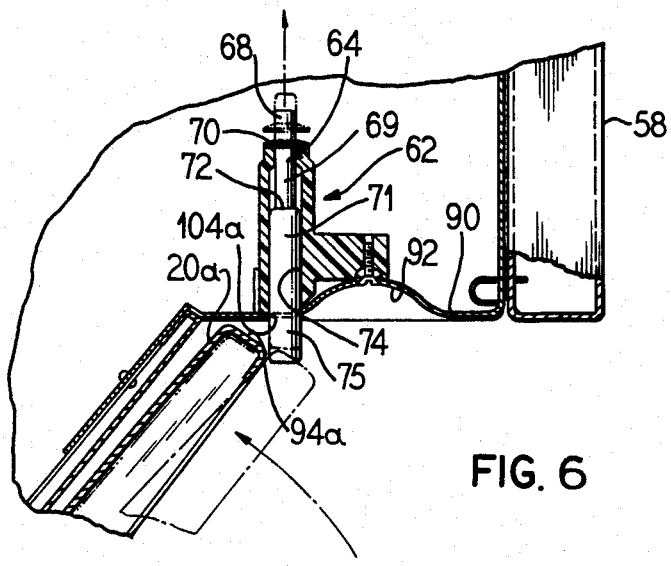
FIG. 6

OPEN LID LATCHING MECHANISM FOR AUTOMATIC WASHER

This is a continuation of application Ser. No. 551,970, filed Nov. 15, 1983.

BACKGROUND OF THE INVENTION

1. Field of the Invention

The present invention relates to latching mechanisms and more particularly for a lid latching mechanism for a stacked combination automatic washer and dryer.

2. Description of the Prior Art

Latching mechanisms used in stacked automatic washers and dryers comprise either a magnetic latching system as is shown in U.S. Pat. No. 3,545,235 or a manually manipulated spring loaded mechanism. The spring loaded system is positive in its latching, but it does require the operator to manually place the latch over the item to be secured. The magnetic latching system is automatic, but the concern for positive control of the lid being secured remains. The magnet strength and air gap influence the latching control.

Other types of latching mechanisms are known in the latching art. For instance, U.S. Pat. No. 1,799,523 shows a pivoting latch 8 with a V-shaped notch used to capture a basement window 1. U.S. Pat. No. 4,023,037 discloses use of either a magnet 40 or a prong 50 to capture a lever arm 30 of a trash bin lid 14. Release of the lid is by means of a button 48 used to apply pressure to oppose either the magnetic force or the prong latching force. U.S. Pat. No. 2,635,909 discloses a latch for holding doors open in which a keeper C is mounted on the face of a refrigerator door and a pivotal latch ring B is secured to a wall of the refrigerator to be engaged by the keeper C when the door is open. A finger piece 23 is provided to lift the latch ring B to release it from the keeper C when it is desired to close the door.

SUMMARY OF THE INVENTION

The present invention provides a means to secure a washer loading door in an out of the way position while the clothes are being transferred from the washer section to the dryer section in a stacked pair of laundry equipment or a combination set of laundry equipment. The means is also used to secure the washer loading door in the out of the way position while the clothes are being initially loaded into the washer section.

The dryer section is located above the washer section and a lower wall of the dryer is provided with an indented portion to provide clearance for the pivoting lid of the washer in the open or latched position. The length of the channel is slightly longer than the width of the lid. The latch comprises a plastic pin mounted vertically in a plastic guide. The guide is secured to the inside of the dryer cabinet by a screw in the base of the channel and two screws in the dryer cabinet bottom wall. The pin is mounted in a vertical orientation so that it is free to slide up and down within the plastic guide. The guide can be installed anywhere along the length of the channel, but the preferred position is adjacent the right edge of the lid as the user faces the washer.

The pin and guide mechanism along with the dryer base channel can be used to secure two different length washer lids without changing the basic construction of the dryer. The pin guide is rotated 180 degrees to an inner position when a short lid is used on the automatic washer.

In operation, as the washer lid is open, the front edge of the lid contacts the pin near the open position. Further rotation of the lid moves the pin upward allowing the lid front edge to move into the channel in the dryer bottom wall. The pin is freed from contact with the lid and falls by gravity, in front of the lid. The lid is thus positively trapped behind the pin and falls forward to rest against the pin. To lower the lid, the operator must push the pin upward past the lid front edge, releasing the lid. This of course is easily done with one hand.

The same operation applies when a shorter lid is utilized, however the edge of the lid does not project into the channel, but rather engages the pin just behind the channel.

BRIEF DESCRIPTION OF THE DRAWINGS

FIG. 3 is a side elevational view partially cut away showing the lid and latch mechanism.

FIG. 4 is a partial side sectional view of the lid and latch mechanism.

FIG. 5 is a top sectional view showing the mounting arrangement of the latch mechanism.

FIG. 6 is a side sectional view showing an alternate mounting arrangement for the latch mechanism.

DESCRIPTION OF THE PREFERRED EMBODIMENTS

Figure 1:
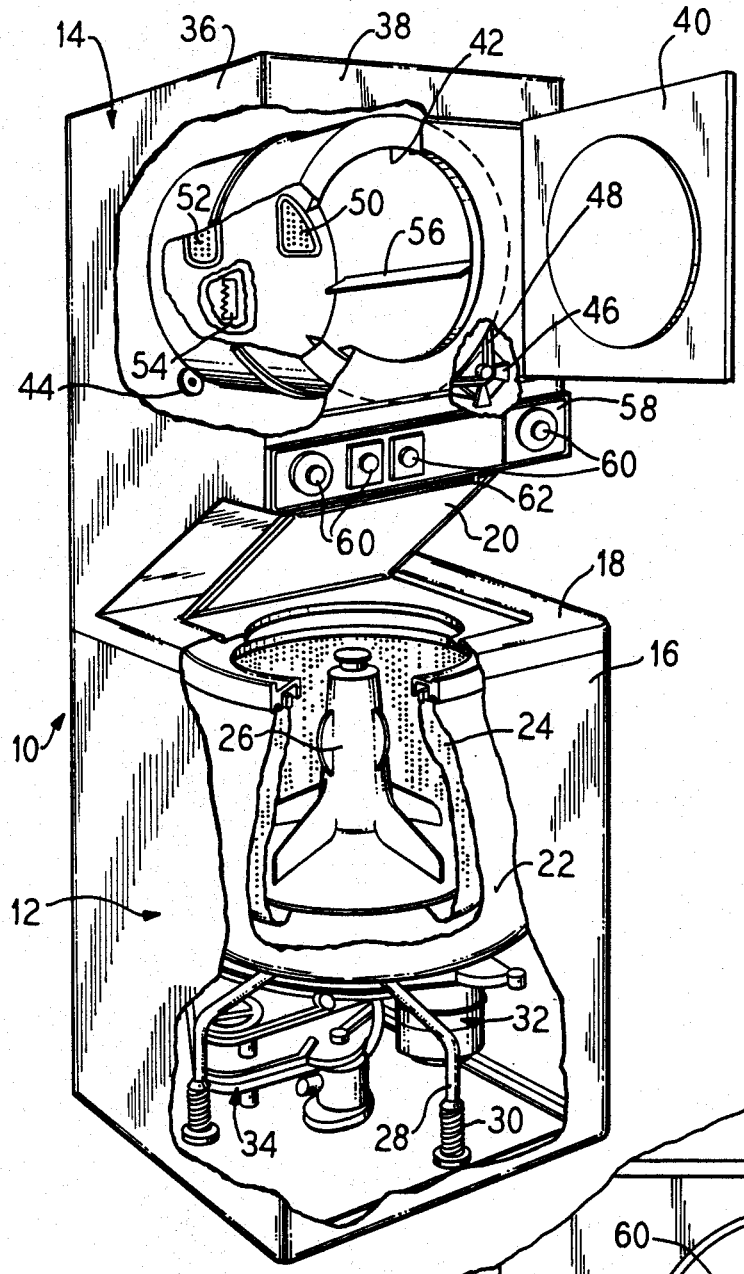
FIG. 1 is a perspective view of a combination automatic washer and dryer embodying the principles of the present invention.

In FIG. 1 there is shown generally at 10 an automatic washer and dryer constructed as a single unit, which includes in a bottom half an automatic washer 12 and in a top half an automatic dryer 14.

The automatic washer 12 is a conventional vertical axis type washer which has an outer cabinet 16 with a horizontal top surface 18 and openable lid 20 providing access into the interior of the washer. The washer has a treatment zone which includes an imperforate wash tub 22, a perforate wash basket 24 and a vertical axis agitator 26. The washer tub mechanism is mounted on legs 28 and includes a spring-type suspension 30. An electric motor 32 is connected via a transmission 34 to operate the washer 12 through a series of spinning and agitation steps.

The dryer 14 is also of conventional design such as that disclosed in U.S. Pat. No. 3,890,719 which was assigned to the same assignee as the present application, and which specification is included herein by reference. The dryer 14 includes an outer cabinet 36 with a vertical front panel 38 having an openable door 40 therein to provide access into the interior of the dryer which includes a dryer treatment zone comprising a rotatable horizontal axis drum 42. The drum 42 is mounted for rotation on rollers 44 and is driven by an electric motor 46 through a transmission means such as a continuous drive belt 48. An air inlet 52 and air outlet 50 and an air heating means 54 are also provided in a normal fashion to provide a continuous stream of heated air into the interior of the rotating drum 42. Interior baffles 56 (only one shown) ensure irregular movement of a clothes load being dried within the drum 42. A single control panel 58 is mounted at the bottom of the dryer housing 36 above the washer 12 and contains controls and switches 60 used to operate both the washer 12 and dryer 14 through their preprogrammed series of automatic laundering steps.

FIGS. 2 through 5 show a lid latching mechanism 62 which is comprised of a latch pin 64 captured in a guide means 66 for limited vertical movement. As best seen in FIGS. 4 and 6, the pin 64 has a narrow upper cylindrical portion 68 which is joined with a wider cylindrical central portion 69 at a shoulder 70. The cenral cylindrical portion 69 is joined to a still wider cylindrical lower portion 71 at a second shoulder 72, thus providing three cylindrical portions of progressively larger diameters from the upper portion 68 to the lower portion 71. The guide 66 has a first internal cylindrical passage 74 which extends from an open bottom end up to a shoulder 76 where it communicates with a second narrower cylindrical passage 78. The first cylindrical passage has a diameter slightly larger than the diameter of the lower portion 71 of the pin 64. The second cylindrical passage has a diameter slightly larger than the diameter of the central pin portion 69, but slightly smaller than the diameter of the lower portion 71. Thus, the pin 64 is free to move upwardly within the guide 66 until the second shoulder 72 of the pin engages the shoulder 76 of the guide. When the pin 64 is inserted into the guide 66, the upper cylindrical portion 68 of the pin projects above a top end 82 of the guide to allow for a retaining member 84 to be positioned on the upper portion 68 of the pin adjacent to the first shoulder 70 to prevent the pin from moving downward within the guide beyond a predetermined limit established by the shoulder 70.

Figure 2:
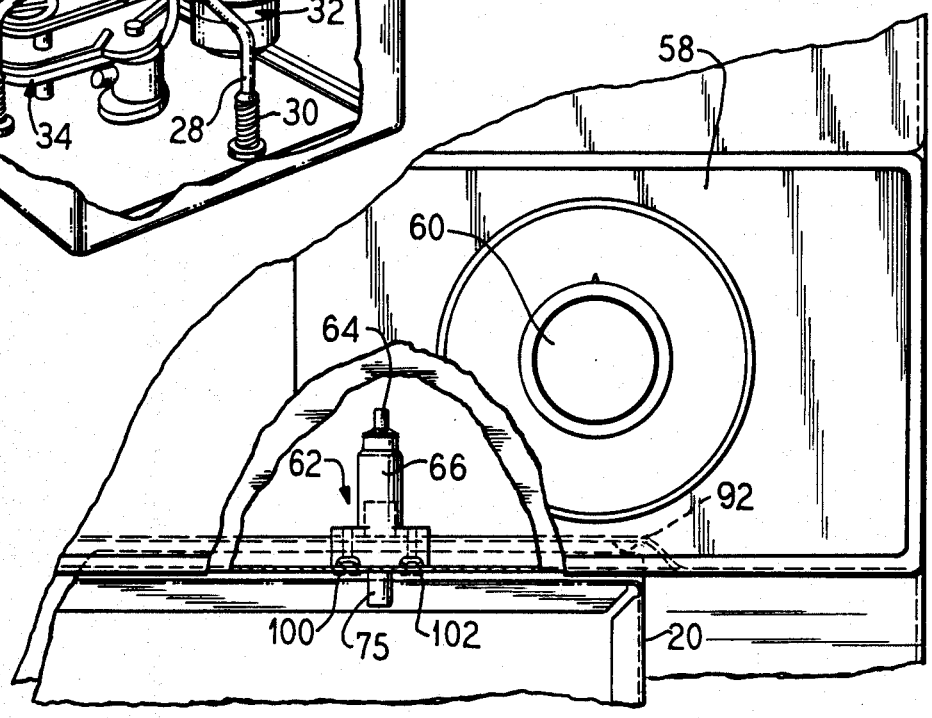
FIG. 2 is a front elevational view partially cut away showing the latch mechanism of the present invention.

The dryer cabinet 36 has a bottom wall 90 including an indented channel portion 92 providing clearance for an end 94 of the lid 20 in the open or latched position as is shown in FIGS. 3 and 4. As seen in FIG. 2, the length of the channel 92 is just longer than the width of the lid 20. The guide 62 is secured on the inside of the dryer cabinet by appropriate fastening means such as screws. A preferred embodiment of the fastening as seen in FIGS. 4 and 5 includes a screw 96 in the base of the channel 92 which extends ino a perpendicular leg 98 of the guide 62 and two lateral screws 100, 102 which engage first portions 101, 103 of the main body portion 105 of the guide 62. An opening 104 in the dryer bottom wall 90 is provided for the pin 64 to protrude through the bottom wall.

Referring to FIG. 3, as the washer lid 20 is opened, it pivots about a fulcrum 104 until the front edge 94 contacts the lower end 75 of the pin 64. Further rotation of the lid 20 moves the pin 64 upward as shown in phantom in FIG. 4 allowing the lid front edge 94 to move into the channel 92 in the dryer bottom wall 90. As the lid 20 is rotated into the channel 92, the pin 64 is freed from contact with the lid and falls by gravity in front of the lid 20. The lid 20 is positively trapped behind the pin 64, and falls forward to rest against the pin. To lower the lid, the operator must push the pin 64 upward past the lid front edge 94, releasing the lid. This can be easily done by the operator with one hand.

In some washer/dryer combinations, the washer opening is smaller and thus the washer lid 20*a* is shorter as seen in FIG. 6. In this arrangement, the front edge 94*a* of the lid 20*a* does not extend up into the channel 92 of the dryer and therefore, the lid 20*a* would not be captured by the latch pin 64. However, the latching mechanism of the present invention can be utilized with this shorter lid without changing the basic construction of the dryer. To accommodate the shorter lid 20*a*, the position of the latch 62 is rotated 180 degrees relative to the channel 92 such that the pin carrying portion is secured behind the channel 92 rather than in front of it. A new opening 104*a* is provided in the dryer bottom wall 90 to allow the bottom end 70 of the pin 64 to protrude. A mounting arrangement similar to that described above is utilized in this alternative emboidment and the operation of the latch mechanism is identical to that described above. However, instead of the rotation of the lid front edge 94*a* into the channel 92, it is rotated to a position behind the pin 64 allowing the pin to fall by force of gravity in front of the lid 20*a*. The same manual release is required to unlatch the lid.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A combination washer/dryer wherein a dryer unit is positioned above a washer unit, a pivotal lid, having a free front edge, being attached to the washer unit and pivotable toward the dryer unit, a dryer cabinet having a bottom wall facing said pivotable lid with an opening therethrough and a latching mechanism, said latching mechanism comprising:

a single piece latch guide mounted in said dryer cabinet and having a vertical passage therein overlying said cabinet bottom wall opening;

a latch pin carried in said vertical passage for limited vertical movement and being continuously biased downwardly by gravity;

said latch pin having a bottom end which protrudes through said opening in said dryer bottom wall being manually accessible below said dryer bottom wall for manual manipulation and being engagable by said free front edge of said pivotable lid;

said latch pin being oriented so that rotation of the washer lid engages said protruding end of said latch pin urging it upwardly until said front edge rotates past said end, said latch pin then dropping by gravity to positively latch the lid in an open position returning said latch pin end to the manually accessible location.

2. A combination washer/dryer according to claim 1, wherein said latch pin comprises an assembly of a latch pin member and a retaining ring held thereon and said vertical passage in said latch guide has an internal shoulder and said latch pin has an external shoulder engagable with said internal shoulder in said vertical passage to provide said limited vertical movement in an upward direction.

3. A combination washer/dryer according to claim 1, wherein said latch pin comprises an assembly of a latch pin member which protrudes above said latch guide and a retaining ring which is secured to said protruding portion to provide said limited vertical movement in a downward direction.

4. A combination washer/dryer according to claim 1, wherein a channel is provided in said bottom wall of said dryer cabinet to receive said front edge of said lid in the open position and said latch mechanism is mounted such that said latch pin end protrudes through said dryer bottom wall in front of said channel.

5. In combination, a combination washer/dryer wherein a dryer unit is positioned above a washer unit;

a pivotal horizontal lid attached to the washer unit having a front edge being vertically movable toward the dryer unit;

a dryer cabinet having a bottom wall facing said pivotal lid with an opening therethrough; and a latch mechanism comprising:

a single piece guide means having a vertical passage therethrough mounted above and in alignment with said dryer bottom wall opening; and a pin means captured in said vertical passage for limited vertical movement and being continuously biased downwardly by gravity with a lower end of said pin means extending beneath said guide means and protruding through said dryer bottom wall opening into an accessible location for manual manipulation and being engagable by said front edge of said pivotal lid;

whereby, a rotation of said lid causes said front edge to engage said lower end of said pin means urging it upwardly until said edge rotates past said pin means, whereupon said pin means drops by gravitational action to positively latch said lid in an open position returning said lower end of said pin means to said accessible location to permit manual disengagement of said pin means from said lid.

6. A combination according to claim 5, wherein said latch pin assembly comprises a latch pin and a retaining ring and said vertical passage in said latch guide has an internal shoulder and said latch pin has an external shoulder engagable with said internal shoulder in said vertical passage to provide said limited vertical movement in an upward direction.

7. A combination according to claim 5, wherein said latch pin assembly comprises a latch pin which protrudes above said latch guide and a retaining ring which is secured to said protruding portion to provide said limited vertical movement in a downward direction.

8. A combination according to claim 5, wherein a channel is provided in said bottom wall of said dryer cabinet to receive front edge of said lid in the open position and said latch mechanism is mounted such that said latch pin assembly end protrudes through said dryer bottom wall in front of said channel.

9. A combination washer/dryer wherein a dryer unit is positioned above a washer unit, a pivotable lid, having a free front edge, being atttached to the washer unit and pivotable toward the dryer unit, a dryer cabinet enclosing said dryer unit having a bottom wall facing said pivotable lid, with an opening through said bottom wall and a three piece latching mechanism, said latching mechanism comprising:

a single piece latch guide member having a body with: a central vertical passage therethrough;

said latch guide member including a portion securable to an interior surface of said bottom cabinet wall such that said vertical passage will be in alignment over said cabinent bottom wall opening;

said latch guide member having a shoulder formed in said vertical passage to define a narrow upper portion of said passage and a wide lower portion of said passage;

a single piece gravity actuated latch pin slidingly carried in said vertical passage for limited vertical movement;

said latch pin comprising a narrow upper section, a wide lower section and an intermediate width central section, each section being separated by a shoulder on said pin;

said narrow upper section protruding beyond a top end of said passage and a wide lower section protruding beyond a bottom end of said dryer cabinet bottom wall such that said lower protruding portion will be exposed below said dryer cabinet bottom wall for manual manipulation of said pin;

a retaining ring secured on said narrow upper section of said pin against a first of said pin shoulders forming a stop to provide said limited vertical movement in a downward direction;

a second of said pin shoulders engagable with said passage shoulder to provide said limited vertical movement in an upward direction;

said latch pin being oriented so that rotation of said lid causes said front edge to engage said lower end of said pin urging it upwardly until said edge rotates past said pin, whereupon said pin will drop by gravitational action to positively lock said lid in open position returning said protruding lower section of said pin to said accessible location to permit said pin to be manually urged upwardly by manual manipulation of said protruding lower section to a position above said lid edge to unlock said lid for movement of said lid to a closed position.

* * * * *